US008764478B2

(12) United States Patent
Lin et al.

(10) Patent No.: US 8,764,478 B2
(45) Date of Patent: Jul. 1, 2014

(54) MULTI-SERIAL PORT CONNECTION DEVICE AND CONNECTION CARD THEREOF

(71) Applicant: Sunix Co., Ltd., New Taipei (TW)

(72) Inventors: Ming-Cheng Lin, New Taipei (TW); Pei-Feng Huang, New Taipei (TW); Zong-Ren Zhang, New Taipei (TW)

(73) Assignee: Sunix Co., Ltd., New Taipei (TW)

( * ) Notice: Subject to any disclaimer, the term of this patent is extended or adjusted under 35 U.S.C. 154(b) by 49 days.

(21) Appl. No.: 13/717,017

(22) Filed: Dec. 17, 2012

(65) Prior Publication Data

US 2013/0242497 A1 Sep. 19, 2013

(30) Foreign Application Priority Data

Mar. 13, 2012 (TW) ..... 101108439 A

(51) Int. Cl.
*H01R 13/66* (2006.01)

(52) U.S. Cl.
USPC ..... 439/498

(58) Field of Classification Search
USPC ..... 439/498; 326/37; 361/760, 679.32
See application file for complete search history.

(56) References Cited

U.S. PATENT DOCUMENTS

| | | | | | |
|---|---|---|---|---|---|
| 5,162,675 | A * | 11/1992 | Olsen et al. | 326/37 |
| 5,572,400 | A * | 11/1996 | Roesner et al. | 361/679.58 |
| 5,576,935 | A * | 11/1996 | Freer et al. | 361/785 |
| 5,659,800 | A * | 8/1997 | Zhang et al. | 710/62 |
| D422,968 | S * | 4/2000 | Tsai et al. | D13/147 |
| D438,512 | S * | 3/2001 | Nishio et al. | D13/147 |
| D438,842 | S * | 3/2001 | Nishio et al. | D13/147 |
| 6,505,095 | B1 * | 1/2003 | Kolls | 700/244 |
| 6,853,551 | B2 * | 2/2005 | Baar et al. | 361/679.33 |
| 7,813,113 | B2 * | 10/2010 | Chuang | 361/679.01 |
| 7,839,628 | B1 * | 11/2010 | Sivertsen | 361/679.32 |
| 8,014,544 | B2 * | 9/2011 | Freels et al. | 381/120 |
| 8,145,831 | B2 * | 3/2012 | Oshima et al. | 711/103 |
| 8,284,552 | B2 * | 10/2012 | Sivertsen | 361/679.32 |
| D679,656 | S * | 4/2013 | Richards et al. | D13/147 |
| D686,161 | S * | 7/2013 | Richards et al. | D13/147 |
| 8,570,760 | B2 * | 10/2013 | Chen | 361/760 |
| 2013/0242497 | A1 * | 9/2013 | Lin et al. | 361/679.32 |

* cited by examiner

*Primary Examiner* — Alexander Gilman
(74) *Attorney, Agent, or Firm* — Birch, Stewart, Kolasch & Birch, LLP

(57) ABSTRACT

A multi-serial port connection device has a connection card and a cable. The connection card has a serial signal transceiving control module and at least one Mini DisplayPort connector. The serial signal transceiving control module has at least two sets of serial I/O pins compatible with DB9 connector standard. The two sets of serial I/O pins are connected to twenty contacts of the Mini Display Port connector. The cable has a plug, at least two DB9 sockets for the connection of two external electronic devices with DB9 connectors. The multi-serial port connection device can reduce the space occupied by connectors on the connection card.

20 Claims, 6 Drawing Sheets

MULTI-SERIAL PORT CONNECTION DEVICE AND CONNECTION CARD THEREOF

BACKGROUND OF THE INVENTION

1. Field of the Invention

The invention relates to a connection device and, in particular, to a multi-serial connection device and a connection card thereof.

2. Description of Related Art

A serial connector refers to a serial communication port. The prefix 'multi' here refers to the Component Object Model (COM) interface, which is the specification for currently existing multiple serial signaling interfaces, such as RS232, RS422 and RS485. The serial connectors are roughly classified according to the number of contacts into the D-type 9-pin serial port (DB9) and D-type 25-pin serial port (DB25). However, with the trend of computer miniaturization, as shown in FIG. 6, most computer manufacturers tend to use the Universal Serial Bus (USB) connector 72 (supporting serial signal transmissions) or Mini DisplayPort connector 73 (supporting audio/video signal transmissions) that is even smaller than the DB9 connector 71. Since the USB connector is also a serial communication interface, there is a low probability that future computers will use DB9 or DB25 as the standard interface. They will have to face the fate of being eliminated.

The DB9 standard has been popular for many years, and is commonly seen in industrial automation and business automation electronic devices. Such electronic devices are usually controlled or managed by computers and communicate with each other through the DB9 standard. Therefore, if computers no longer support DB9 connectors, great inconvenience will inevitably be resulted for the control or management of these electronic devices in the future. It is thus imperative to improve the multi-serial port connectors.

SUMMARY OF THE INVENTION

In view of the foregoing, the invention provides a multi-serial port connection device and a connection card thereof.

To achieve the above-mentioned objective, the connection device includes a connection card and a cable.

The connection card has a serial signal transceiving control module and at least one Mini DisplayPort connector. The serial signal transceiving control module has at least two sets of DB9 serial signal I/O pins. The Mini DisplayPort connector contains twenty contacts. The serial signal I/O pins of the two DB9 connectors electrically connect to the contacts of the Mini DisplayPort connector.

The cable has a plug, a least two DB9 sockets, and at least one wire set. The plug has at least one Mini DisplayPort plug for plugging into the Mini DisplayPort connector of the connection card. The contacts of the Mini DisplayPort plug are in contact with the contacts of the Mini DisplayPort connector. The wire set electrically connects contacts of the Mini DisplayPort plug corresponding to the serial signal I/O pins to the two DB9 connectors.

Since the Mini DisplayPort connector has twenty contacts, they are sufficient for the two DB9 connectors for transmitting serial signals to the two sets of serial signal I/O pins.

The size of the Mini DisplayPort connector is about half that of the DB9 connector. Therefore, the invention can install a Mini DisplayPort connector that is far smaller than a DB9 connector on the connection card. The Mini DisplayPort connector is capable of connecting to two DB9 ports of external electronic devices via the cable. This greatly reduces the space occupied by the connectors on a computer. It is therefore ideal for compact computers or laptop computers.

DETAILED DESCRIPTION OF THE PREFERRED EMBODIMENT

Figure 1:
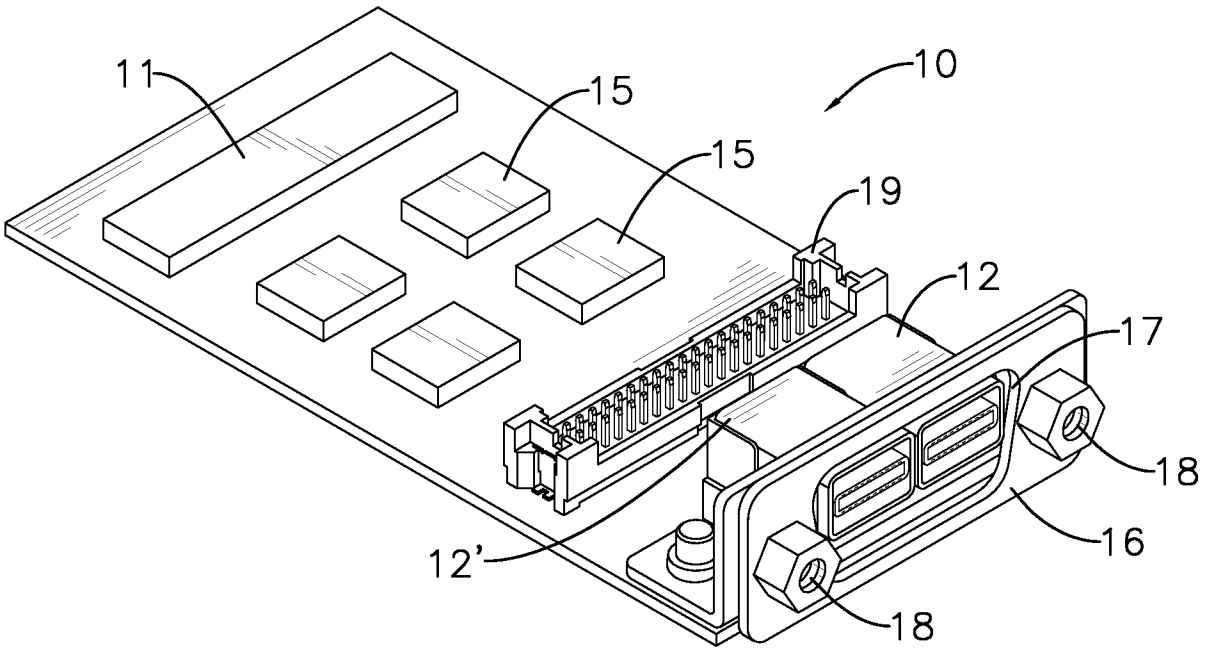
FIG. 1 is a perspective view of a connection card of the invention.
Figure 2:
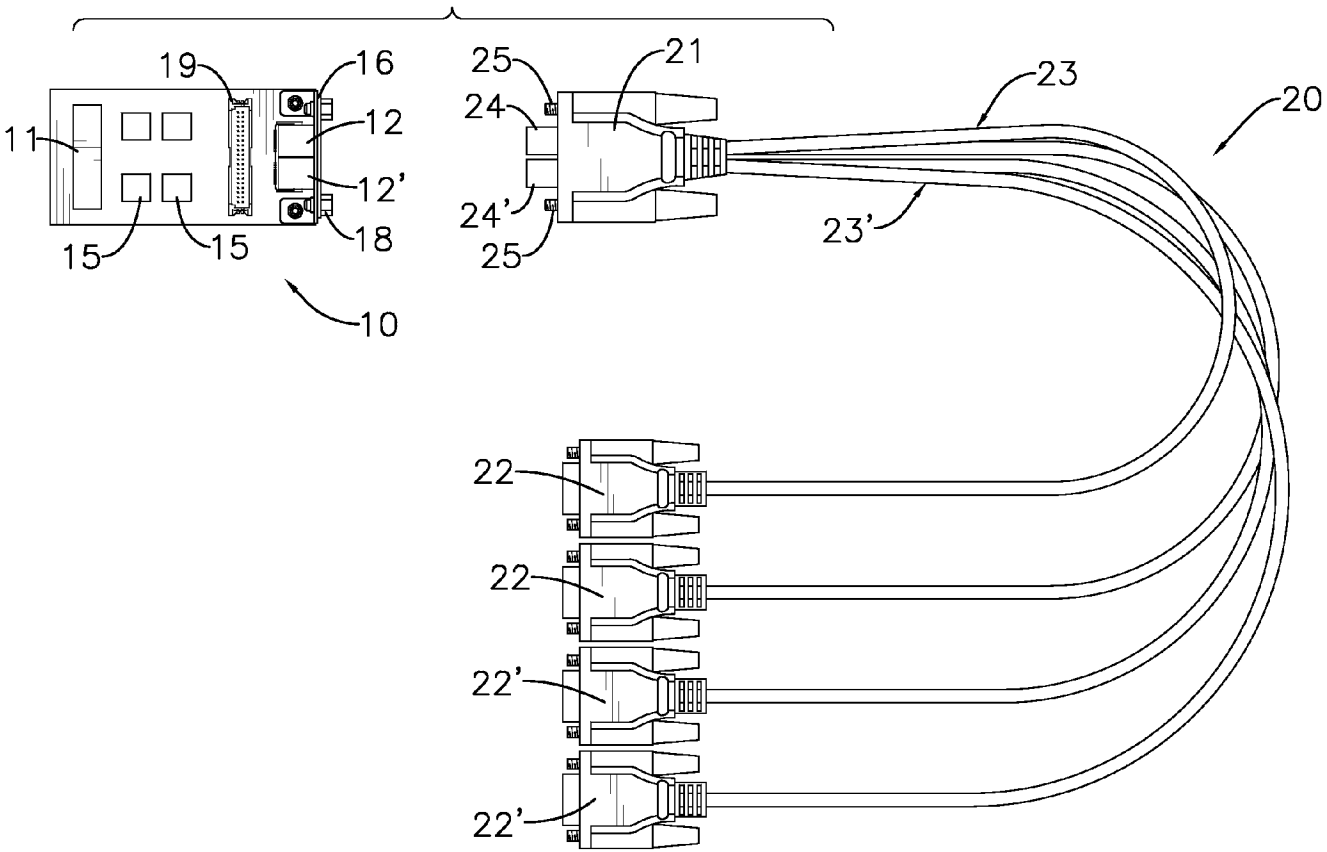
FIG. 2 is a planar view of a connection device of the invention.

With reference to FIGS. 1 and 2, a multi-serial port connection device comprises a connection card 10 and a cable 20.

Figure 3:
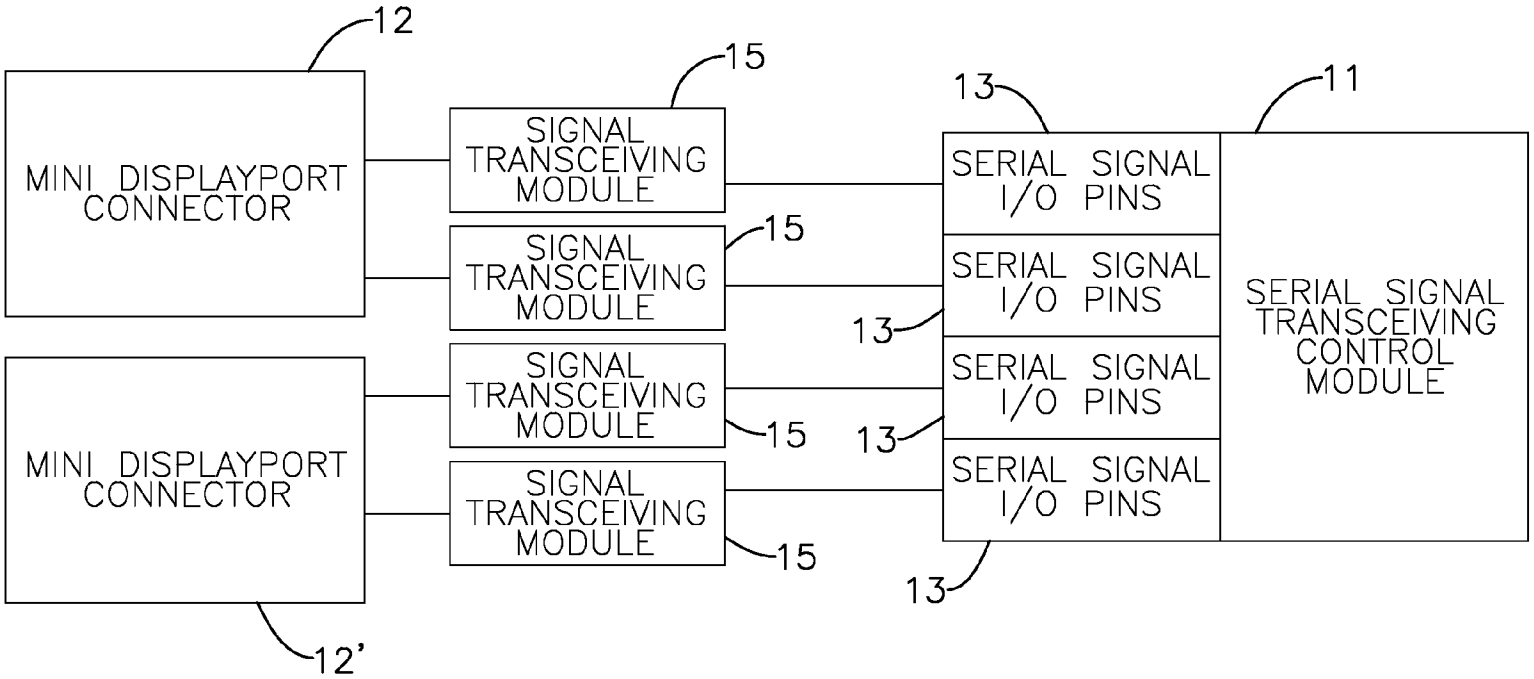
FIG. 3 is a circuit block diagram of the connection card in FIG. 1.
Figure 4:
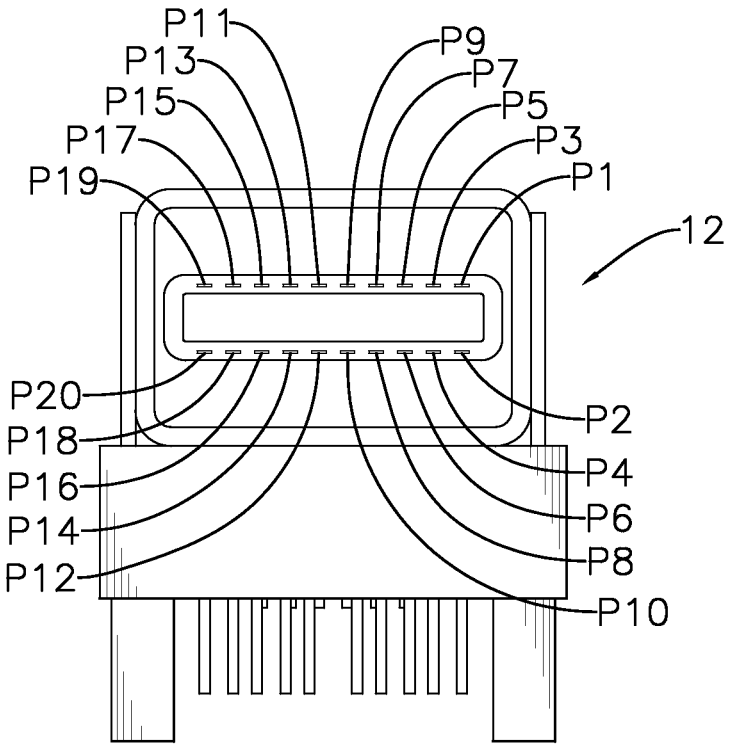
FIG. 4 is a planar view of a Mini DisplayPort connector.

The connection card 10 has a serial signal transceiving control module 11 and at least one Mini DisplayPort connector 12. The serial signal transceiving control module 11 has at least two sets of serial signal I/O pins 13 of the DB9 connector standard as shown in FIG. 3. With reference to FIG. 4, the Mini DisplayPort connector 12 has 20 contacts, P1~P20. The serial signal I/O pins 13 of the DB9 standard are respectively connected to the contacts of the Mini DisplayPort connector 12.

In this embodiment, the serial signal transceiving control module 11 has four sets of serial signal I/O pins 13. The connection card 10 is further provided with another Mini DisplayPort connector 12'. The four sets of serial signal I/O pins 13 are connected to the two Mini DisplayPort connectors 12, 12'. The connection card 10 has four signal transceiving modules 15, which electrically connect between the four sets of serial signal I/O pins 13 and the corresponding Mini DisplayPort connectors 12, 12'. Moreover, a fixing board 16 formed with an opening 17 that matches with the DB9 connector is mounted at one side of the connection card 10. Two nuts 18 are provided beside the opening 17. The two Mini DisplayPort connectors 12, 12' are exposed from the opening 17.

The serial signal transceiving control module 11 can be a universal asynchronous receiver transmitter (UART) chip, with the model number of SUN2410, SUN2212, or SUN1999. The serial signal transceiving control module 11 can convert serial signals received by the serial signal I/O pins 13 into parallel signals. The serial signal transceiving control module 11 also can convert parallel signals into serial signals to be output from the serial signal I/O pins 13. The serial signal transceiving control module 11 can also be some other serial signal transmission chip that converts the serial signals received by the serial signal I/O pins 13 into serial signals of different standards. The serial signal I/O pins 13 comprise contacts for RxD, TxD, CTS, DSR, DCD, RI, DTR and RTS signals. These contacts are for serial signal I/O.

The Mini DisplayPort is originally used for audio/video (AV) signal transmissions. The invention uses the twenty pins of the Mini DisplayPort connectors 12, 12' for the transmissions of two serial signals. Therefore the twenty pins of the Mini DisplayPort connectors 12, 12' have to be connected according to the definitions of the serial signal I/O pins 13. The following describes one connection embodiment, with reference to FIG. 4:

| Contact definition | Contact number (For first serial signal) | Contact number (For second serial signal) |
|---|---|---|
| DCD | P1 | P11 |
| RxD | P2 | P12 |
| TxD | P3 | P13 |
| DTR | P4 | P14 |
| GND | P5 | P15 |
| DSR | P6 | P16 |
| RTS | P7 | P17 |
| CTS | P8 | P18 |
| RI | P9 | P19 |
| Reserved contact | P10 | P20 |

In the above table, the signal standard of P1 through P9 satisfies one set of serial signal I/O pins 13 of the DB9 standard. Therefore, one Mini DisplayPort connector 12 can be used to provide the contacts required by two DB9 connectors. The connection card 10 thus has two Mini DisplayPort connectors 12, 12' to provide four sets of DB9 serial signal I/O pins 13. Since the size of the Mini DisplayPort connectors 12, 12' is only about half that of a DB9 connector, this embodiment only occupies the space required by one DB9 connector, greatly reducing the space required by the connector on the connection card 10.

Figure 5:
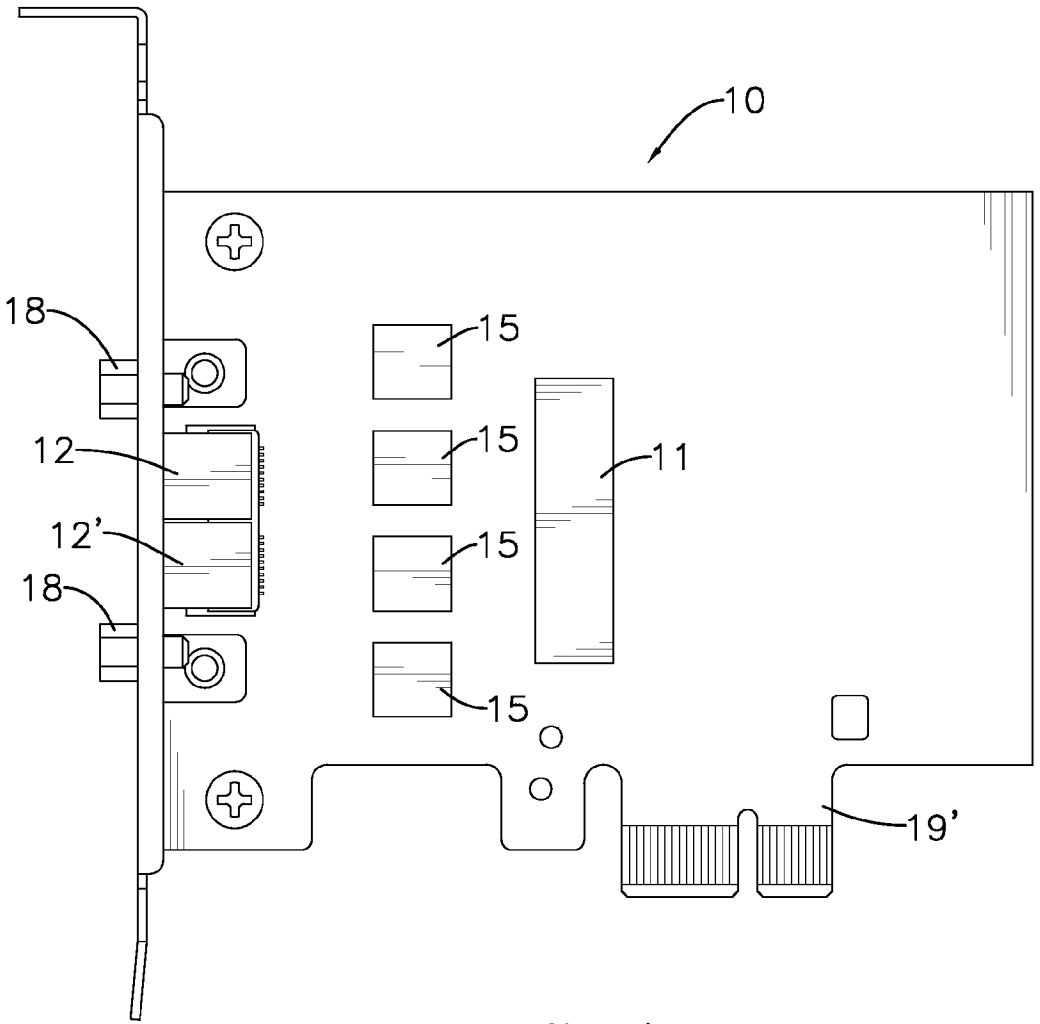
FIG. 5 is a planar view of the connection card of another embodiment of the invention.
Figure 6:
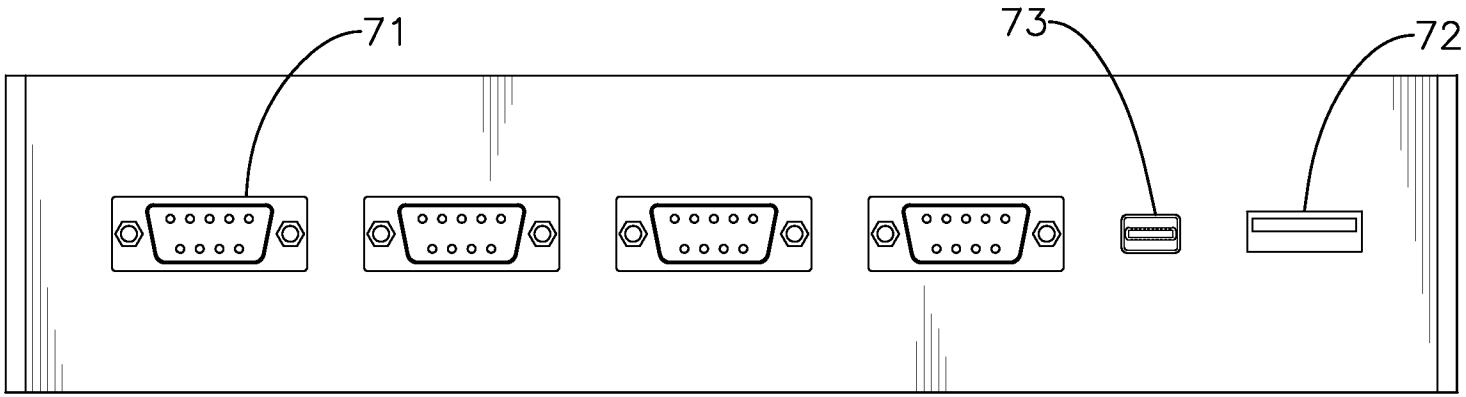
FIG. 6 PRIOR ART
FIG. 6 is a planar view of a conventional DB9 connector, USB connector, and Mini DisplayPort connector.

The connection card 10 can be further provided with a pin header connector 19 for the connection with the motherboard of a computer or some other extension card. The pin header connector 19 may receive parallel signals. Or, as shown in FIG. 5, one side of the connection card 10 is provided with a golden finger connector 19' for the connection with the motherboard of a computer or some other extension card.

Since the size and the amount of the pins of the Mini DisplayPort connectors 12, 12' is different from that of DB9 connector, the connection card 10 should be used with the cable 20. The cable 20 has a plug 21, at least two DB9 sockets 22 and at least one wire set 23. The ping 21 has at least one Mini DisplayPort plug 24 to be inserted into the Mini DisplayPort connector 12 of the connection card 10. The contacts of the Mini DisplayPort plug 24 are in contact with the contacts of the Mini DisplayPort connector 12, resulting in an electrical connection to the two sets of serial signal I/O pins 13 of the serial signal transceiving control module 11.

The wire set 23 electrically connects the contacts of the Mini DisplayPort plug 24 corresponding to the two sets of serial signal I/O pins 13 of the serial signal transceiving control module 11 to the two DB9 sockets 22. In this embodiment, the cable 20 further includes two DB9 sockets 22' and another wire set 23'. The plug 21 is provided with another Mini DisplayPort plug 24', thereby plugging the two Mini DisplayPort plugs 24, 24' into the two Mini DisplayPort connectors 12, 12'. The two wire sets 23, 23' coupled to the contacts of the two Mini DisplayPort plugs 24, 24' corresponding to the four serial signal I/O pins 13 to the four DB9 sockets 22, 22'.

Moreover, the plug 21 is provided with two bolts 25 corresponding to the two fixing nuts 18 on the fixing board 16 of the connection card 10 for the connection with the two fixing nuts 18.

In practice, the two Mini DisplayPort plugs 24, 24' of the plug 21 are plugged into the two Mini DisplayPort connectors 12, 12'. The four DB9 sockets 22, 22' then electrically connect to the four sets of serial signal I/O pins 13. This enables four external electronic devices with the DB9 plugs to connect to the DB9 sockets 22, 22'. The two Mini DisplayPort connectors 12, 12' on the connection card 10 only occupy the space of one DB9 connector. It can greatly reduce the required space on the computer, which is ideal for compact computers or laptop computers.

While the invention has been described by way of example and in terms of the preferred embodiment, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A multi-serial port connection device, comprising:

a connection card comprising a serial signal transceiving control module having at least two sets of serial signal I/O pins of a D-type 9-pin serial port (DB9); and at least one Mini DisplayPort connector having twenty contacts, wherein the two sets of the serial signal I/O pins are coupled to the Mini DisplayPort connector; and a cable comprising a plug having at least one Mini Display Port plug to be plugged into the Mini DisplayPort connector of the connection card so that contacts of the Mini DisplayPort plug are coupled to the contacts of the Mini DisplayPort connector;

at least two DB9 sockets; and at least one wire set, each wire set being applied to couple the serial signal I/O pins of the Mini DisplayPort connector to the DB9 sockets through the Mini DisplayPort plug.

2. The multi-serial port connection device as claimed in claim 1, wherein the serial signal transceiving control module has four sets of the serial signal I/O pins, the connection card further has another Mini DisplayPort connector, and the four sets of the serial signal I/O pins are electrically connected to the two Mini DisplayPort connectors; and the cable further includes another two DB9 sockets and another wire set and the plug further has another Mini DisplayPort plug so that the two Mini DisplayPort plugs are plugged into the two Mini DisplayPort connectors, each wire set is applied to couple the serial signal I/O pins of the Mini DisplayPort connector to the DB9 sockets through the Mini DisplayPort plug.

3. The multi-serial port connection device as claimed in claim 2, wherein the connection card has four signal transceiving modules, each signal transceiving module electrically connects between the corresponding set of the serial signal I/O pins and the corresponding Mini DisplayPort connector.

4. The multi-serial port connection device as claimed in claim 1, wherein the serial signal transceiving control module is a universal asynchronous receiver transmitter chip and includes contacts for RxD, TxD, CTS, DSR, DCD, RI, DTR, and RTS signals to convert serial signals received by the serial signal I/O pins into parallel signals or to convert received parallel signals into serial signals to be output via the serial signal I/O pins.

5. The multi-serial port connection device as claimed in claim 2, wherein the serial signal transceiving control module is a universal asynchronous receiver transmitter chip and includes contacts for RxD, TxD, CTS, DSR, DCD, RI, DTR, and RTS signals to convert serial signals received by the serial signal I/O pins into parallel signals or to convert received parallel signals into serial signals to be output via the serial signal I/O pins.

6. The multi-serial port connection device as claimed in claim 3, wherein the serial signal transceiving control module is a universal asynchronous receiver transmitter chip and includes contacts for RxD, TxD, CTS, DSR, DCD, RI, DTR, and RTS signals to convert serial signals received by the serial signal I/O pins into parallel signals or to convert received parallel signals into serial signals to be output via the serial signal I/O pins.

7. The multi-serial port connection device as claimed in claim 1, wherein the serial signal transceiving control module converts the serial signals received by the serial signal I/O pins info other serial signals of a different standard.

8. The multi-serial port connection device as claimed in claim 2, wherein a fixing board is mounted at one side of the connection card and is formed with an opening compatible for the DB9 connector, two nuts are provided beside the opening, and the two Mini DisplayPort connectors are exposed from the opening; and the plug is provided with two bolts corresponding to the two nuts for fixing onto the two nuts.

9. The multi-serial port connection device as claimed in claim 3, wherein a fixing board is mounted at one side of the connection card and is formed with an opening compatible for the DB9 connector, two nuts are provided beside the opening, and the two Mini DisplayPort connectors are exposed from the opening; and the plug is provided with two bolts corresponding to the two nuts for fixing onto the two nuts.

10. A connection card comprising:

a serial signal transceiving control module having at least two sets of serial signal I/O pins of a D-type 9-pin serial port (DB9); and at least one Mini DisplayPort connector having twenty contacts, wherein the two sets of the serial signal I/O pins coupled to the contacts of the Mini DisplayPort connector.

11. The connection card as claimed in claim 10 comprising two Mini DisplayPort connectors, wherein the serial signal transceiving control module has four sets of serial signal I/O pins electrically connected to the contacts of the two Mini DisplayPort connectors.

12. The connection card as claimed in claim 11 further comprising four signal transceiving modules, each of which electrically connects between the corresponding set of serial signal I/O pins and the corresponding Mini DisplayPort connector.

13. The connection card as claimed in claim 10, wherein the serial signal transceiving control module is a universal asynchronous receiver transmitter chip and includes contacts for RxD, TxD, CTS, DSR, DCD, RI, DTR, and RTS signals to convert the serial signals received by the serial signal I/O pins into parallel signals or to convert received parallel signals into serial signals to be output via the serial signal I/O pins.

14. The connection card as claimed in claim 11, wherein the serial signal transceiving control module is a universal asynchronous receiver transmitter chip and includes contacts for RxD, TxD, CTS, DSR, DCD, RI, DTR, and RTS signals to convert the serial signals received by the serial signal I/O pins into parallel signals or to convert received parallel signals into serial signals to be output via the serial signal I/O pins.

15. The connection card as claimed in claim 12, wherein the serial signal transceiving control module is a universal asynchronous receiver transmitter chip and includes contacts for RxD, TxD, CTS, DSR, DCD, RI, DTR, and RTS signals to convert the serial signals received by the serial signal I/O pins into parallel signals or to convert received parallel signals into serial signals to be output via the serial signal I/O pins.

16. The connection card as claimed in claim 10, wherein the serial signal transceiving control module converts the serial signals received by the serial signal I/O pins into other serial signals of a different standard.

17. The connection card as claimed in claim 11, wherein the serial signal transceiving control module converts the serial signals received by the serial signal I/O pins into other serial signals of a different standard.

18. The connection card as claimed in claim 11, wherein a fixing board is mounted at one side of the connection card and is formed with an opening compatible for the DB9 connector, two nuts are provided beside the opening, and the two Mini DisplayPort connectors are exposed from the opening; and the plug is provided with two bolts corresponding to the two nuts for fixing onto the two nuts.

19. The connection card as claimed in claim 12, wherein a fixing board is mounted at one side of the connection card and is formed with an opening compatible for the DB9 connector, two nuts are provided beside the opening, and the two Mini DisplayPort connectors are exposed from the opening; and the plug is provided with two bolts corresponding to the two nuts for fixing onto the two nuts.

20. The connection card as claimed in claim 13, wherein a fixing board is mounted at one side of the connection card and is exposed from the opening; and the socket is provided with two bolts corresponding to the two nuts for fixing onto the nuts.

* * * * *